US007600661B2

(12) United States Patent
Adachi

(10) Patent No.: US 7,600,661 B2
(45) Date of Patent: Oct. 13, 2009

(54) NAILING MACHINE AND MAGAZINE

(75) Inventor: Michiaki Adachi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/571,903

(22) PCT Filed: Oct. 15, 2004

(86) PCT No.: PCT/JP2004/015265

§ 371 (c)(1),
(2), (4) Date: Feb. 22, 2007

(87) PCT Pub. No.: WO2005/037493

PCT Pub. Date: Apr. 28, 2005

(65) Prior Publication Data

US 2007/0267457 A1 Nov. 22, 2007

(30) Foreign Application Priority Data

Oct. 16, 2003 (JP) ..... 2003-356847

(51) Int. Cl.
*B25C 1/16* (2006.01)
*B25C 7/00* (2006.01)

(52) U.S. Cl. ..... 227/120; 227/8; 227/109; 227/119; 227/125

(58) Field of Classification Search ..... 227/8, 227/109, 119, 120, 125
See application file for complete search history.

(56) References Cited

U.S. PATENT DOCUMENTS 3,504,840 A * 4/1970 Wandel et al. ..... 227/130
5,593,079 A * 1/1997 Mukoyama et al. ..... 227/8
5,653,371 A * 8/1997 Hou ..... 227/109
6,161,746 A * 12/2000 Wey ..... 227/109
6,296,167 B1 * 10/2001 Jen ..... 227/120
6,398,097 B1 * 6/2002 Liang ..... 227/109
6,499,642 B1 * 12/2002 Amada ..... 227/119
6,626,345 B2 * 9/2003 Amada ..... 227/120
6,908,021 B1 * 6/2005 Wang ..... 227/8
6,966,477 B1 * 11/2005 Chien-Kuo et al. ..... 227/8
7,273,160 B2 * 9/2007 Wey ..... 227/125
7,303,103 B2 * 12/2007 Wang ..... 227/8

(Continued)

FOREIGN PATENT DOCUMENTS

JP Y-46-012800 5/1971

(Continued)

*Primary Examiner*—Rinaldi I. Rada
*Assistant Examiner*—Gloria R. Weeks
(74) *Attorney, Agent, or Firm*—Morgan, Lewis & Bockius LLP

(57) ABSTRACT

A nailing machine includes a magazine for storing nails, an injection port, a drive mechanism, and a nail detecting lever. The nail detecting lever formed with a detecting end capable of advancing to inside of a nail containing portion is rotatably arranged between a downwardmost pusher and a pusher thereabove on one side of the magazine. An idle striking preventing arm has an upper end arranged at a vicinity of a starter, and a lower end arranged to be opposed to an end portion on a side opposed to a detecting end of the detecting lever and which is operated to start a nailing machine in cooperation with the starter. Further, the other side of the magazine is formed with a detecting end containing portion for containing the detecting end of the nail detecting lever.

10 Claims, 9 Drawing Sheets

U.S. PATENT DOCUMENTS

| | | | | |
|---|---|---|---|---|
| 2005/0150929 | A1* | 7/2005 | Wey | 227/120 |
| 2007/0194077 | A1* | 8/2007 | Lee | 227/8 |

FOREIGN PATENT DOCUMENTS

| | | |
|---|---|---|
| JP | U-61-127984 | 8/1986 |
| JP | A-06-297353 | 10/1994 |
| JP | U-7-20271 | 4/1995 |
| JP | A-7-246574 | 9/1995 |
| JP | A-7-256569 | 10/1995 |
| JP | A-8-47871 | 2/1996 |
| JP | UM-3073468 | 9/2000 |
| JP | A-2002-346950 | 12/2002 |

* cited by examiner

NAILING MACHINE AND MAGAZINE

TECHNICAL FIELD

The present invention relates to a nailing machine in which connected nails constituted by adhering contiguous nails by adhering or the like to connect are charged into a magazine in a shape of a straight sheath and successively pressed to supply into an injection port formed at a front end portion of the magazine, and the nail supplied into the injection port is continuously struck to a struck member by a drive mechanism driven impulsively. Particularly, the invention relates to an idle striking preventing mechanism of a nailing machine for preventing the nailing drive mechanism from being operated when there is not present the nail charged into the magazine.

BACKGROUND ART

In a background art, there is used a nailing machine in which connected nails connected by adhering contiguous nails in a state of aligning a number of nails in parallel are charged into a magazine, the connected nails at inside of the magazine are successively supplied into the injection port formed at the front end portion of the magazine and the nails supplied into the injection port are continuously struck by an impulse mechanism driven by power of compressed air or the like. According to the nailing machine, the nails are struck by starting the impulse mechanism by operating a trigger lever formed at a grip portion of a housing containing the impulse mechanism. Further, in constructing an interior member of a house building or a step of fabricating furniture, there is used a finishing nail having a small head such that the head of the struck nail becomes inconspicuous after striking the nail. In such a nailing machine of striking the finishing nail, there is formed an idle striking preventing mechanism for preventing the nailing machine from being started when the nail in the magazine is not present in order to prevent the nailing face from being damaged by a driver of striking the nail by operating the impulse mechanism of the nailing machine when the nails in the magazine are consumed to nullify.

According to the finishing nail used in the above-described furniture or the like, a shape of a nail head portion is formed to be extremely small to make the nail head portion after having been struck inconspicuous. Therefore, in such a nailing machine, the nails are charged in a state of bringing foot tips of the finishing nails into contact with a bottom portion of the magazine at inside of the magazine for charging the finishing nails. Further, there is provided a bar for restraining the nail from moving upward by advancing upward from a head portion of a short nail charged into the magazine such that the short expendable (nail) is not moved upward at inside of the magazine. There are arranged a plurality of the bars along an axial direction of the nail to be able to be arranged upward from respective head portions of nails having different lengths. Further, the respective bars are urged forward by a spring and the bars are constituted as pushers for pressing a rear end of the connected nails charged into the magazine. The nailing machine using such a finishing nail is described in, for example, JP-U-3073468.

Further, a general nailing machine using a comparatively large-sized nail is provided with a contact member projected in a direction of a front end of a nose portion formed with the injection port for striking out the nail. Further, an impulse mechanism is started in cooperation with the contact member and the trigger member. According to such a nailing machine, at a time point at which a pusher engaged with a rear portion of connected nails charged into a magazine for pressing the connected nails forward advances in accordance with consumption of the nails at inside of the magazine and the nail is not present, the pusher is engaged with a contact member sliding along the nose portion to lock the contact member and even when the trigger lever is operated, the nailing machine is not started. Therefore, idle striking is prevented.

However, according to the above-described nailing machine using the finishing nail, there is a case in which the nailing machine is not provided with the contact member projected in the direction of the front end of the nose portion. In this case, the above-described idle striking preventing mechanism cannot be adopted. Further, in such a magazine, a slider is mounted to open one side of a magazine main body and the pusher is moved rearward by moving the slider rearward for charging the connected nails. According to the mechanism for preventing idle striking by moving the pusher forward, there is a case in which when the slider is operated to move to a rear position in order to charge the connected nails in the magazine, the pusher is moved rearward, the idle striking preventing state is resolved and the nailing machine is started.

In order to resolve such a drawback, JP-A-2002-346950 proposes an idle striking preventing mechanism in which a nailing machine is provided with a pivoting lever directly engaged with a nail charge into a magazine, one end portion of the pivoting lever is made to advance into the magazine to be engaged with the nail, other end side of the pivoting lever is arranged to be opposed to an idle striking preventing arm an upper end of which is arranged at a vicinity of a trigger lever for starting the nailing machine in cooperation with the trigger lever, when the nail at inside of the magazine is not present, the nailing machine is prevented from being operated by hampering the idle striking preventing arm from being operated by rotating the pivoting lever.

However, according to the idle striking preventing mechanism of the background art in which the nail at inside of the magazine is directly detected by the pivoting lever, although the rotatable pivoting lever engaged with a shaft portion of the nail at inside of the magazine is provided, for example, in a case of an extremely slender finishing nail having a diameter of a shaft portion thereof of about 0.6 mm used in furniture or the like, an angle of rotating the rotating lever between a state in which the pivoting lever is engaged with the nail and a state in which the rotating lever is not engaged therewith cannot be made to be large, it is difficult to firmly engage the rotating lever with the idle striking preventing arm and idle striking cannot firmly be prevented.

Patent Reference 1: JP-U-3073468

Patent Reference 2: JP-A-2002-346950

DISCLOSURE OF THE INVENTION

The problem of the invention is to provide a nailing machine capable of being applied to a magazine for charging a finishing nail having an extremely slender diameter of a shaft portion of the nail and capable of preventing idle striking by firmly detecting that a number of the nails becomes equal to or smaller than a predetermined number of pieces thereof.

In order to resolve the above-described problem, according to an idle striking preventing mechanism of the nailing machine of the invention, in a nailing machine including a magazine for containing a number of nails connected to each other, a pusher for supplying the nail contained in the magazine into an injection port formed on a front side of the magazine, driving means for striking out the nail supplied into the injection port from the injection port, and starting means for starting the driving means, characterized in being constituted such that the magazine is formed with a nail containing portion for containing connected nails and guiding the nails in a direction of the injection port, a plurality of streaks of pushers for pressing the connected nails in the direction of the injection port by being engaged with the nail at a rearmost portion of the connected nails charged into the nail containing portion are arranged in a length direction of the nail, wherein a nail detecting lever formed with a detecting end capable of advancing to inside of the nail containing portion of the magazine is rotatably arranged between the downwardmost pusher and the pusher thereabove on one side of the magazine interposing the nail containing portion, a lower end of an idle striking preventing arm an upper end of which is arranged at a vicinity of the starting means and which is operated to start the naming machine in cooperation with the starting means is arranged to be opposed to an end portion on a side opposed to a detecting end of the nail detecting lever, further, a face of the nail containing portion on other side of the magazine interposing the nail containing portion is formed with a detecting end containing portion of the detecting lever.

Figure 1:
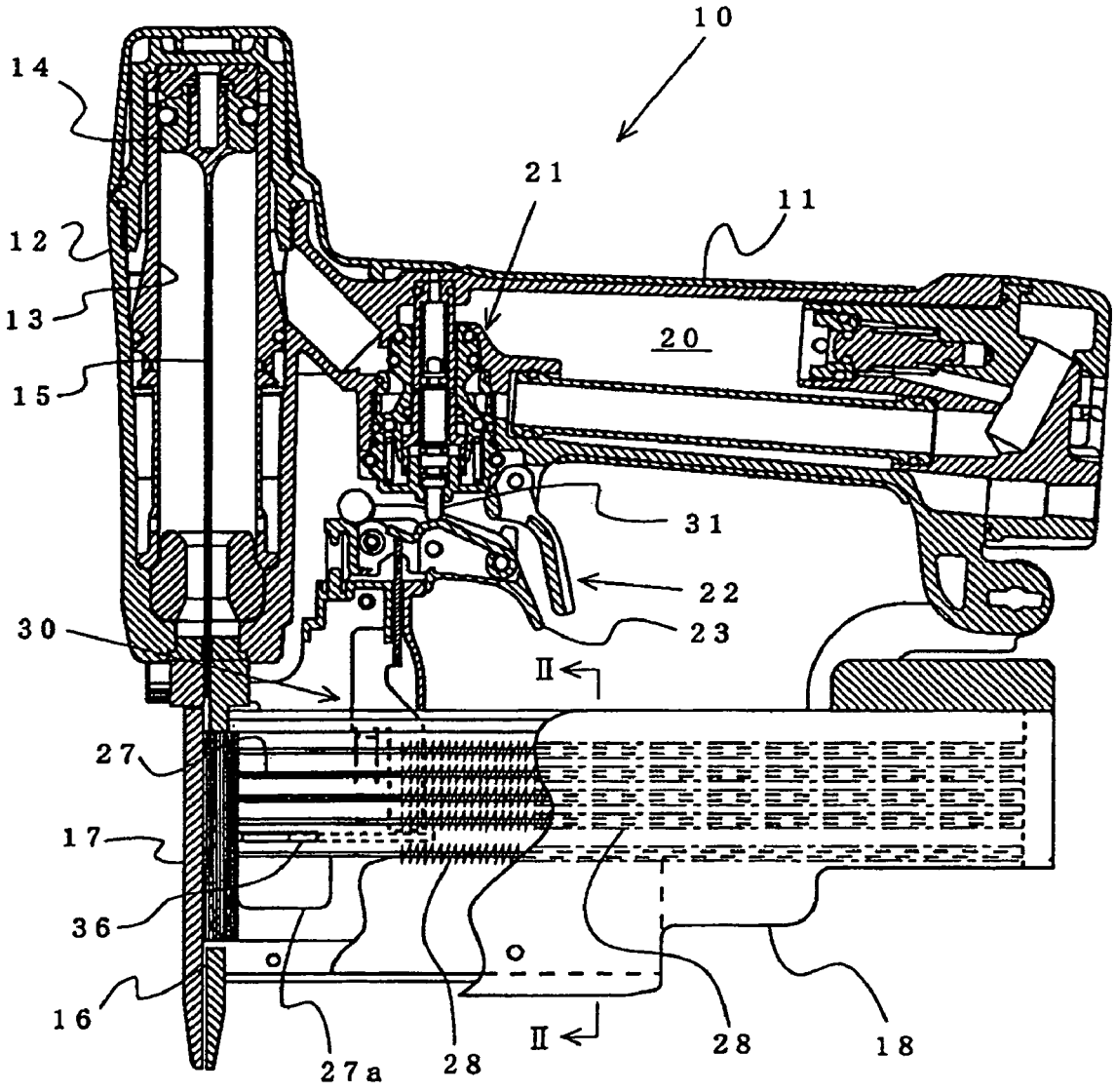
FIG. 1 is a sectional view of a nailing machine of the invention.

Further, notations of the drawings, numeral 10 designates a nailing machine, numeral 18 designates a magazine, numeral 22 designates a starting mechanism (starting means), numeral 26 designates a nail containing portion, numeral 27 designates a pusher, numeral 30 designates an idle striking preventing mechanism, numeral 33 designates an idle striking preventing arm, numeral 35 designates a detecting end, numeral 36 designates a nail detecting lever, and numeral 39 designates a recess portion.

BEST MODE FOR CARRYING OUT THE INVENTION

Embodiments of the present invention will be described with reference to the exemplary embodiments shown in the accompanying drawings. FIG. 1 shows the nailing machine 10 driven by compressed air according to an embodiment of the invention. Inside of a housing 12 in a hollow shape integrally formed with a grip portion 11 is contained with a drive mechanism constituted by a cylinder 13, a piston 14 contained at inside of the cylinder 13 and a driver 15 integrally coupled with the piston 14. A lower side of the housing 12 is attached with a nose portion 17 forming an injection port 16 for guiding to strike a nail. The driver 15 is contained in and guided by the injection port 16 formed at the nose portion 17. The magazine 18 containing connected nails is supported between the nose portion 17 and a rear end portion of the grip portion 11. Connected nails at inside of the magazine 18 are successively supplied into the injection port 16 of the nose portion 17. Further, by introducing compressed air into the cylinder 13 of the drive mechanism, the piston 14 is driven and the driver 15 coupled with the piston 14 strikes out nails supplied into the injection port 16 to a struck member.

Compressed air for driving the piston 15 is stored at inside of a chamber 20 formed at inside of the grip portion 11 connected to a compressed air supply source. Compressed air in the chamber 20 is introduced into the cylinder 13 by way of a start valve 21 formed at a base portion of the grip 11 to drive the piston 15. Further, the start valve 21 is operated by the starting mechanism 22 (starting means 22) formed downward from the grip portion 11. The starting means 22 is constituted by a trigger lever 23 for operating the start valve 21 by being operated by the hand of an operator.

Figure 2:
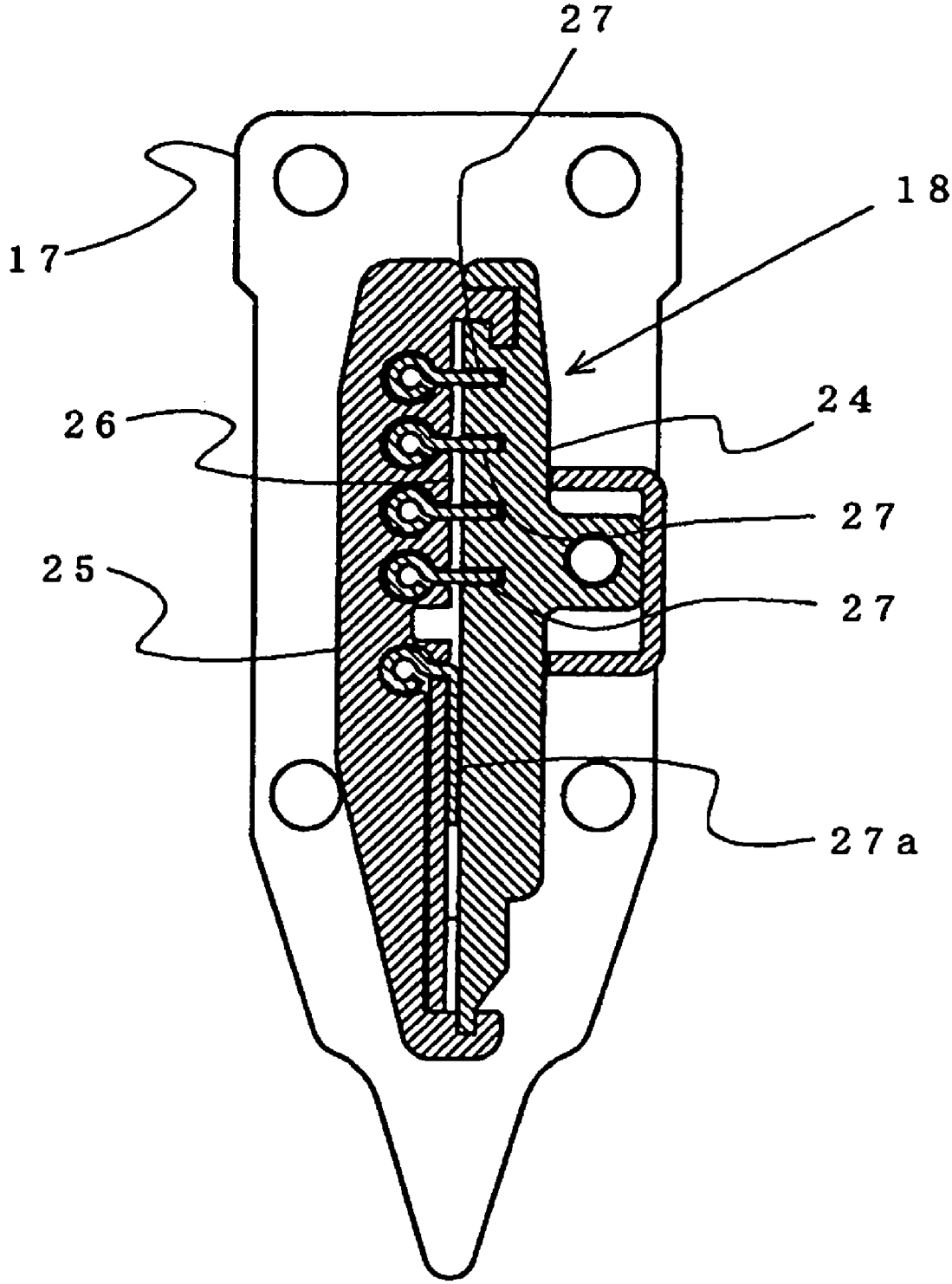
FIG. 2 is a vertical sectional view taken along a line II-II of FIG. 1 showing a magazine portion of the nailing machine of FIG. 1.

The connected nails charged to the magazine 18 are connected in a straight shape by adhering contiguous nails by an adhering agent. The magazine 18 containing the connected nails is constituted by a magazine main body 24 a front end portion of which is attached to the nose portion 17 and a rear end portion of which is supported to be fixed by a rear portion of the grip portion 11, and a slider 25 slidably supported by the magazine main body 24 along a direction of supplying nails. As shown by FIG. 2, the nail containing portion 26 containing the connected nails and introducing to guide the connected nails in a direction of the injection port 16 of the nose portion 17 is formed between the magazine main body 24 and the slider 25. Further, by sliding to move the slider 25 rearward relative to the magazine main body 24, the nail containing portion 26 is opened and the connected nails can be charged into the nail containing portion 26 at a side face of the magazine main body 24.

A side of the slider 25 of the magazine 18 is provided with a plurality of the pushers 27 for pressing the connected nails in a direction of the nose portion 17 by being engaged with a rearmost nail of the connected nails charged into the nail containing portion 26 to supply a front nail into the injection port 16 formed at the nose portion 17 along a length direction of the nail. The respective pushers 27 are urged to a front side independently by springs 28 respectively operated thereto. A pusher 27*a* arranged on the downmost side of the plurality of pushers 27 is arranged at a position engaged with a shaft portion of the shortest nail charged to the magazine 18 and capable of pushing to supply the nail to a front side. The other pushers 27 are set to be arranged respectively upward from head portions of nails of respective sizes charged to the nail containing portion of the magazine 18. Thereby, the pusher 27 arranged downward from the head portion of the nail charged to the nail containing portion 26 of the magazine 18 is engaged with the rear end of the connected nails to press to supply the connected nails to the front side. Further, the pusher 27 arranged upward from the head portions of the connected nails are arranged upward from the head portions of the connected nails to restrict the connected nails from moving upward at inside of the nail containing portion 26 of the magazine 18.

A vicinity of the starting means 22 is formed with the idle striking preventing mechanism 30 for preventing the nailing machine 10 from being started such that the start valve 21 is not operated by the starting means 22 when the nail is not present at inside of the magazine 18. The idle striking preventing mechanism 30 is constituted by a contact lever, the idle striking preventing arm 33 and the nail detecting lever 36. The contact lever is axially supported rotatably by the trigger lever 23 constituting the starting means 22 to operate a valve stem 31 of the start valve 21. The idle striking preventing arm 33 is arranged to correspond to a side of a free end 32*a* of the contact lever 32 at an upper end thereof and is slidably supported in an up and down direction along the side face of the magazine main body 24. The nail detecting lever 36 controls the idle striking preventing arm 33 by detecting the connected nails at inside of the magazine 18.

Figure 3:
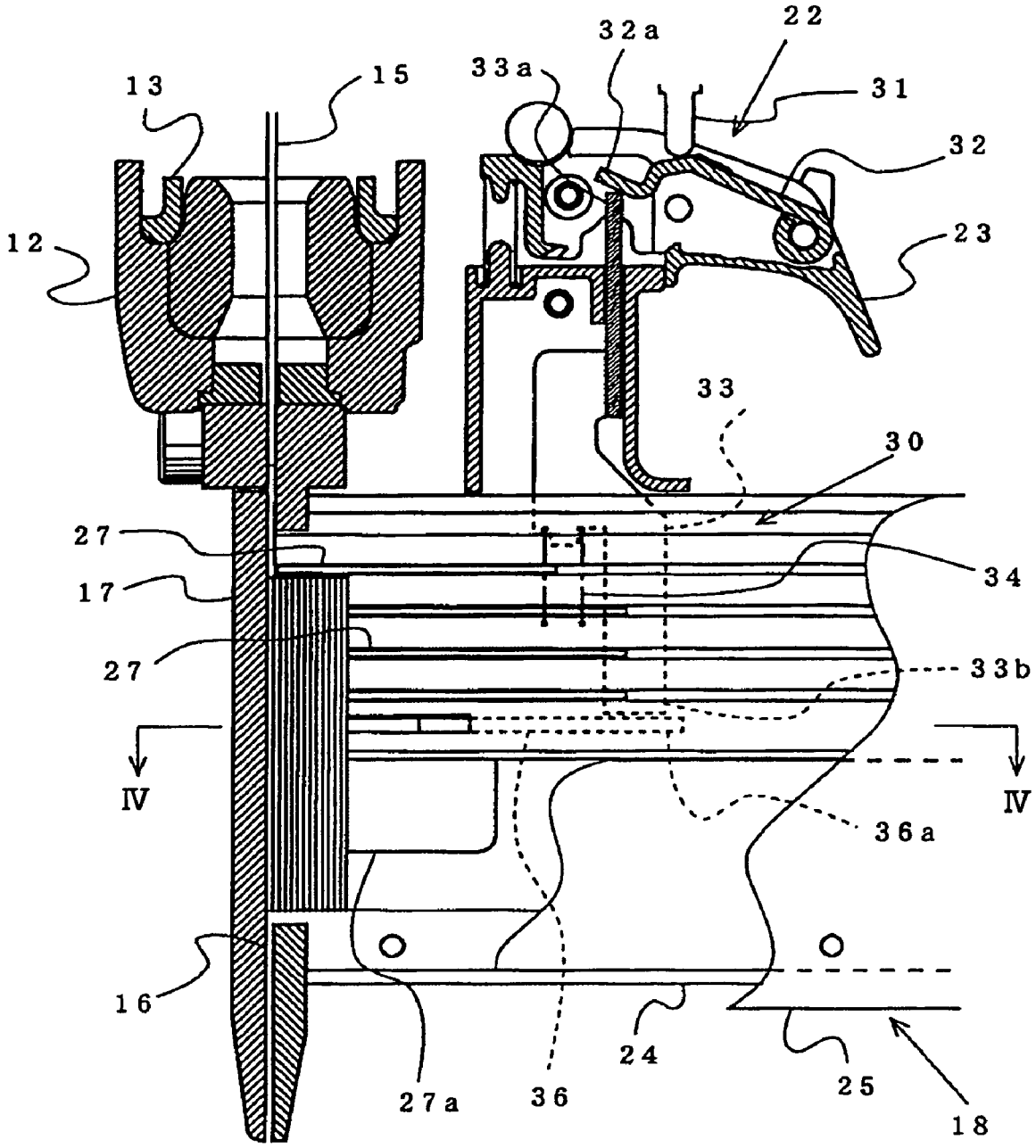
FIG. 3 is a sectional view showing an idle striking preventing mechanism of the nailing machine of FIG. 1.

As shown by FIG. 3, the idle striking preventing arm 33 is urged upward by a spring 34 and the free end 32*a* of the contact lever 32 is lifted upward by an upper end portion 33*a* of the idle striking preventing arm 33. A spring urge force of the idle striking preventing arm 33 is small and when the trigger lever 23 is operated, the idle striking preventing arm 33 is moved in a lower direction against the urge force of the spring 34 by pressing the free end 32*a* of the contact lever 32 by a resistance of operating the valve stem 31.

Figure 4:
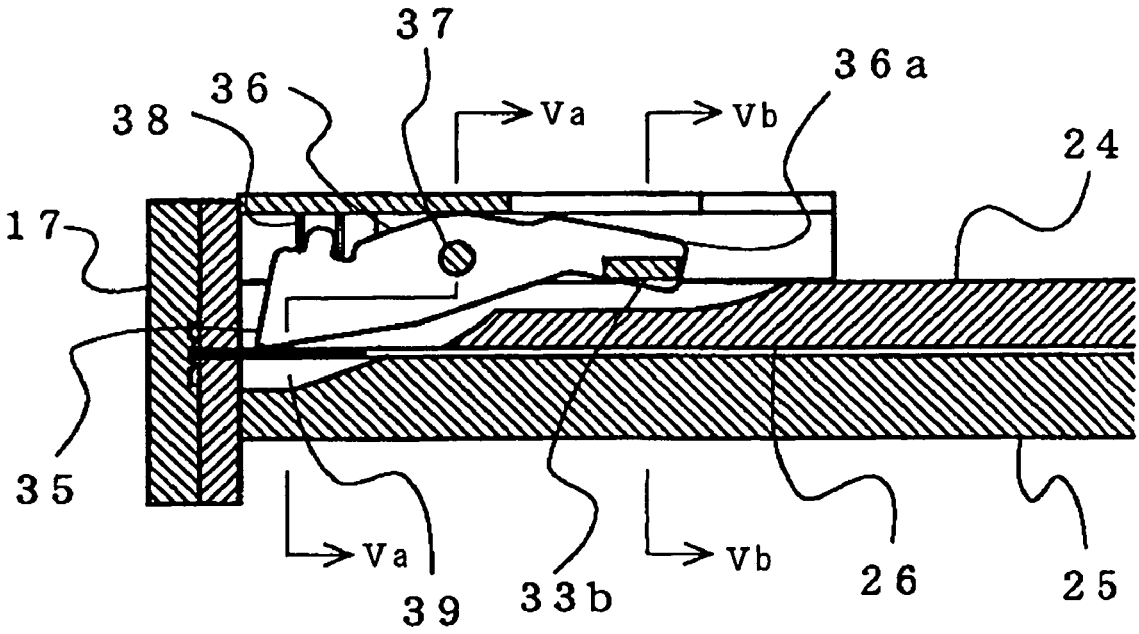
FIG. 4 is a sectional view taken along a line IV-IV of FIG. 3 showing a state in which a predetermined amount or more of nails remain in the magazine.

Further, as shown by FIG. 4, a side of the magazine main body 24 is provided with the nail detecting lever 36 by rotatably supporting a center portion thereof by a rotating shaft 37 at the magazine main body 24. The nail detecting lever 36 is provided with the detecting end 35 to be engaged with the connected nails contained at inside of the nail containing portion 26 at one end thereof. The detecting end 35 is provided to be able to advance in a direction of the nail containing portion 26 between the downmost pusher 27*a* and the pusher 27 upward therefrom. An end portion 36*a* of the nail detecting lever 36 on a side opposed to a side of the detecting end 35 is arranged to be opposed to a lower end portion 33*b* of the idle striking preventing arm 33. The nail detecting lever 36 is urged by the spring 38 to pivot in a direction in which the detecting end 35 invades inside of the nail containing portion 26 of the magazine. When nails are charged in the magazine 18, the detecting end 35 is engaged with the shaft portion of the connected nails and the end portion 36*a* is pivoted to a position capable of being engaged with the lower end portion of the idle striking preventing arm 33 against the urge force. Thereby, the idle striking preventing arm 33 is hampered from moving down.

As shown by FIG. 4 and FIG. 5, the slider 25 opposed to the magazine main body 24 by interposing the nail containing portion 26 is formed with the recess portion 39 for containing the detecting end 35 of the nail detecting lever 36 at a nail guide face on a side of the slider 25 opposed to the detecting end 35 of the nail detecting lever 36. The nail detecting lever 36 is pivoted by the spring 38 until the detecting end 35 of the nail detecting lever 36 traverses the nail containing portion 26 to be contained in the recess portion 39 on the side of the slider 25 by that the connected nails at inside of the magazine 18 are not present and the detecting end 35 of the nail detecting lever 36 is not engaged with the nail. The detecting end 35 of the nail detecting lever 36 is contained in the recess portion 39 by forming the recess portion 39 on the side of the slider 25 in this way, and therefore, an angle of rotating the nail detecting lever 36 from a state of detecting the connected nails to a state in which the connected nails are not detected can be increased and a relationship of engaging the nail detecting lever 36 and the idle striking preventing arm 33 can be ensured.

That is, the nail detecting lever 35 can be rotated between a first position at which the idle striking preventing arm 33 is hampered from moving down by hampering the recess end 35 from advancing to the nail containing portion 26 by being engaged with the shaft portion of the connected nails when the connected nails are contained in the nail containing portion 26, and a second position at which the detecting end 35 is contained at inside of the nail containing portion 26 and the idle striking preventing arm 33 is permitted to move down when the connected nails are not contained at inside of the nail containing portion 26.

Figure 5A:
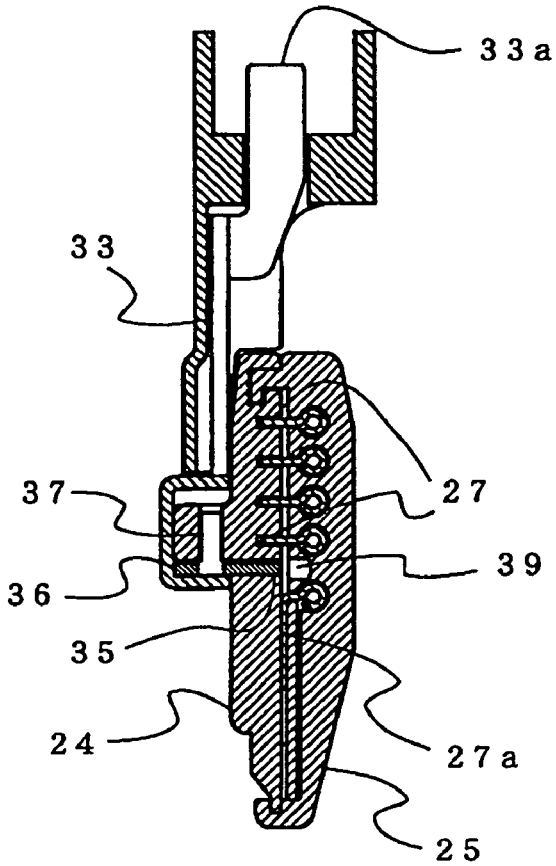
FIG. 5A is a sectional view taken along a line Va-Va of FIG. 4.
Figure 5B:
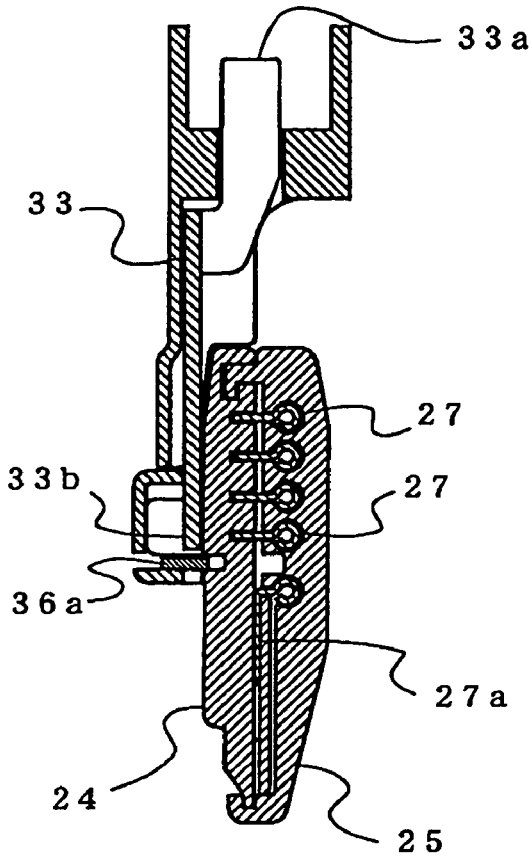
FIG. 5B is a sectional view taken along a line Vb-Vb of FIG. 4.
Figure 6:
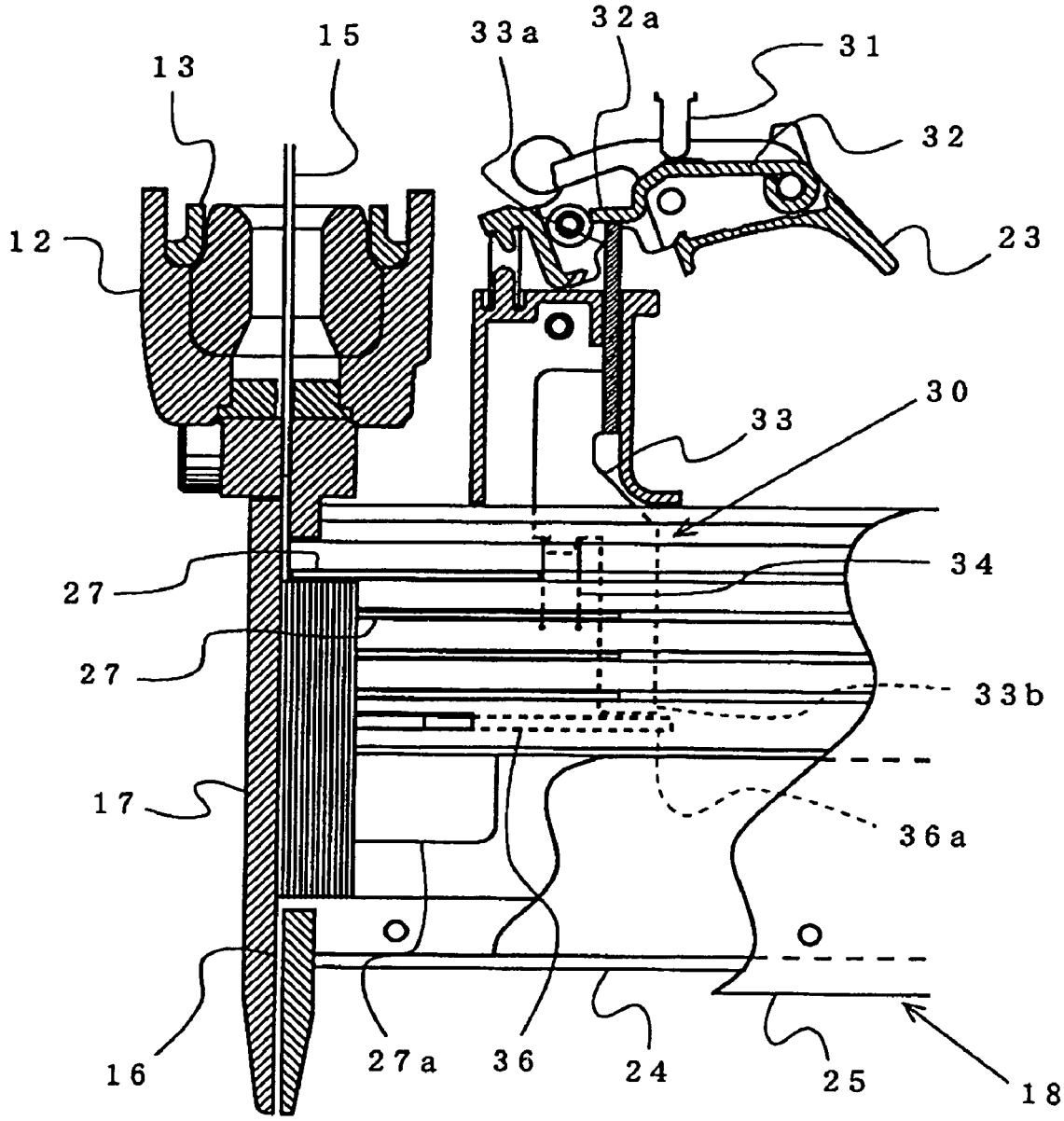
FIG. 6 is a sectional view of a state of operating a trigger lever in a state the same as that of FIG. 4.

Operation of the idle striking preventing mechanism 30 according to the above-described embodiment will be explained. When the predetermined amount or more of the connected nails remain at inside of the magazine 18, as shown by FIG. 4, FIG. 5A, and FIG. 5B, the detecting end 35 of the nail detecting lever 36 is engaged with the nail shaft portion of the connected nails to be pivoted against the urge force in the pivoting direction by the spring 38, and the other end 36*a* of the nail detecting lever 36 is arranged at a position of being engaged with the lower end of the idle striking preventing arm 33. When the trigger lever 23 is operated under the state, as shown by FIG. 6, a base end side of the contact lever 32 is moved upward and a center portion of the contact lever 32 is engaged with the valve stem 31, thereby, the side of the free end 32*a* of the contact lever 32 is going to be moved in the lower direction. However, the idle striking preventing arm 33 is hampered from moving in the lower direction by the other end 36*a* of the nail detecting lever 36 and therefore, the free end 32*a* of the contact lever 32 is maintained at a high position. Thereby, the valve stem 31 of the start valve 21 is operated to be pressed up upward, compressed air is supplied into the cylinder 13 and the nailing machine 10 is started.

Figure 7:
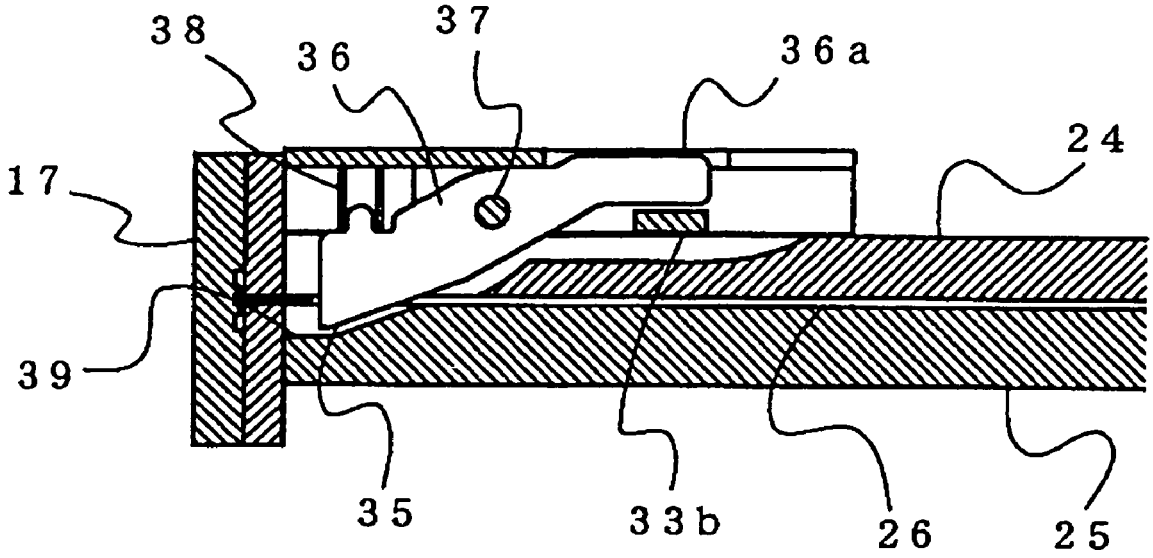
FIG. 7 is a sectional view similar to FIG. 4 showing a state in which the predetermined amount of nails are not present at inside of the magazine.
Figure 8A:
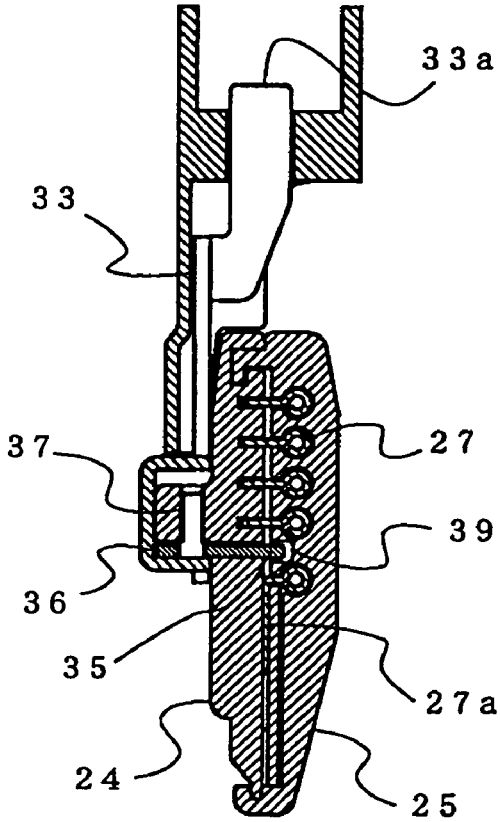
FIG. 8A is a sectional view taken along the line Va-Va of FIG. 4 in a state the same as that of FIG. 7.
Figure 8B:
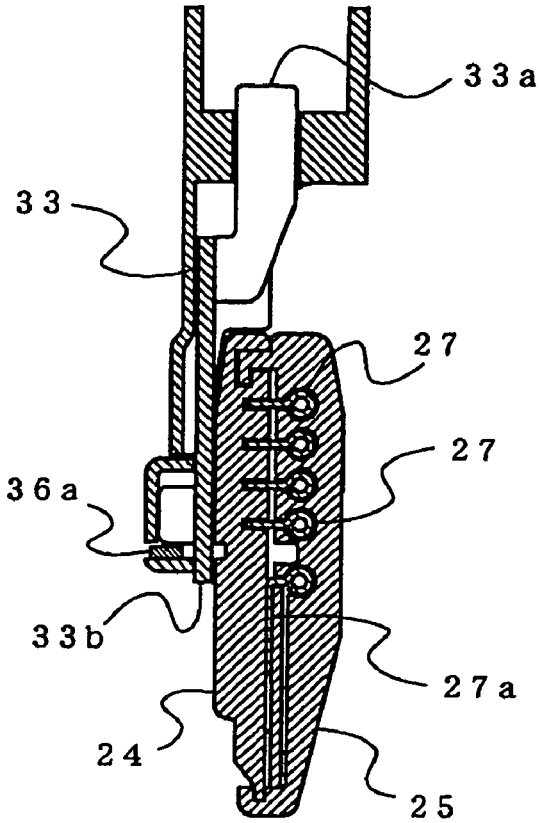
FIG. 8B is a sectional view taken along the line Vb-Vb of FIG. 4 in the state the same as that of FIG. 7.
Figure 9:
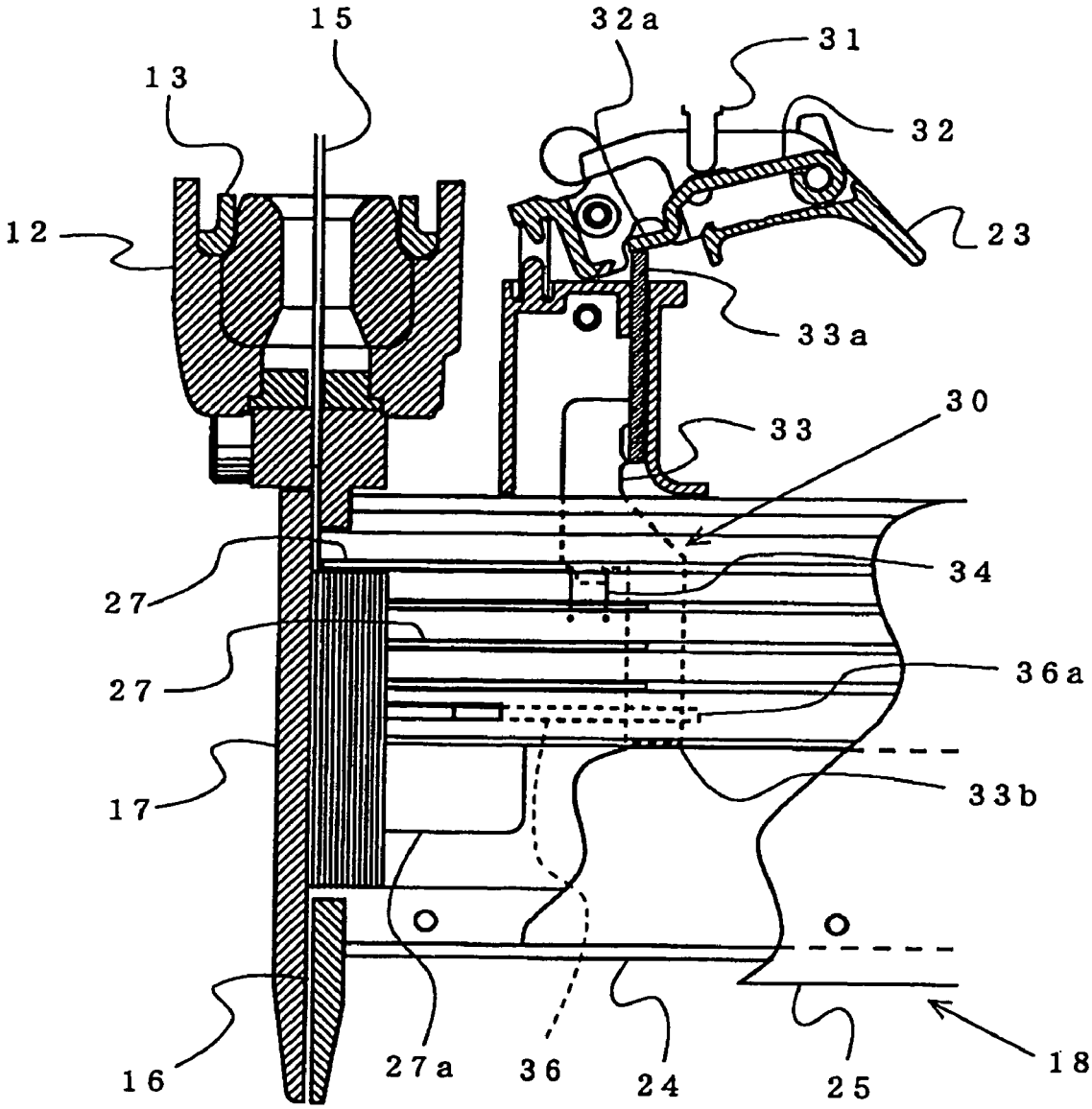
FIG. 9 is a sectional view of a state of operating the trigger lever in the state the same as that of FIG. 7.

When a number of the connected nails remaining in the magazine 18 becomes equal to or smaller than a predetermined number, as shown by FIG. 7 and FIG. 8, the detecting end 35 of the nail detecting lever 36 cannot be engaged with the connected nails, and the detecting end 35 is pivoted by the spring 38 until the detecting end 35 is contained at inside of the recess portion 39 formed at a guide face on the side of the slider 25 by traversing the nail containing portion 26. Thereby, as shown by FIG. 7 and FIG. 8B, the other end 36*a* of the nail detecting lever 36 is moved to a position of being deviated from the lower end of the idle striking preventing arm 33 to maintain a state in which the idle striking preventing arm 33 can be moved in the lower direction. When the trigger lever 23 is operated under the state, as shown by FIG. 9, the base end side of the contact lever 32 is moved upward in accordance with pivoting the trigger lever 23 and the center portion of the contact lever 32 is engaged with the valve stem 31. However, the side of the free end 32*a* is moved in the lower direction to move the idle striking preventing arm 33 in the lower direction and the free end 32*a* of the contact lever 32 is moved downward. Therefore, even when the trigger lever 23 is operated, the valve stem 31 of the start valve 21 cannot be operated and therefore, the nailing machine 10 is not started.

The above-described embodiment is constituted such that when the nails in the magazine 18 are not present, the nail detecting lever 36 is made to advance to the lower side of the idle striking preventing arm 33 to hamper the idle striking preventing arm 33 from being operated in the lower direction. However, idle striking may be prevented by forming the idle preventing arm to be operated in an up and down direction in cooperation with operation of the trigger lever 23 and making the trigger lever 23 unable to operated by permitting the idle striking preventing arm to be operated in the lower direction in a state in which the nails remain at inside of the magazine 18 and hampering the idle striking preventing arm from being operated in the lower direction by the nail detecting ever 36 when the nails are not present at the inside of the magazine 18. Further, although according to the embodiment, the recess portion 39 is formed at the guide face of the side of the slider 25 for containing the detecting end 35 of the nail detecting lever 36, there may be constructed a constitution in which the detecting end 35 can be moved by providing a notch or an opening portion at a portion on the side of the slider 25 in correspondence therewith.

As described above, according to the embodiment, the nail detecting lever 36 is rotatably arranged between the lowermost pusher 27*a* and the pusher 27 thereabove for supplying nails at inside of the magazine 18 to the front side and therefore, the nail detecting lever 36 can be operated in correspondence with nails of all the sizes charged to the magazine 18. Further, the detecting end 35 of the nail detecting lever 36 is contained in the recess portion 39 formed at the guide face of the slider 25 on the opposed side interposing the nail containing portion 26 and therefore, when the nails at inside of the magazine 18 are not present, the nail detecting lever 36 is pivoted by the large rotational angle and therefore, an amount of moving the other end 36*a* of the nail detecting lever 36 between when the nails remain at inside of the magazine 18 and when the nails at inside of the magazine 18 are not present, states of engagement and disengagement with and from the idle striking preventing arm 33 arranged to be opposed to the other end 36*a* can be made to be clear, as a result, the nailing machine having the stable idle striking preventing mechanism is provided.

INDUSTRIAL APPLICABILITY

According to the invention, the nail detecting lever is formed between the pusher at the downmost position of pushers dividedly formed by a plural number and the pusher thereabove and the detecting lever is engaged with the shaft portion of the nails at inside of the nail containing portion. Therefore, presence or absence of the nail can be detected from the shortest nail to the maximally long nail charged to the magazine. Further, even when the pusher is moved rearward for charging the nail, the idle striking preventing state is not released and the nailing machine is not started in operating to charge the nail.

Further, the portion of containing the detecting end of the nail detecting lever is formed at the face of the nail containing portion opposed to the detecting end of the nail detecting lever. Therefore, when the nails in the magazine are consumed by a predetermined number of pieces thereof, the detecting end of the nail detecting bar is not engaged with the nail at inside of the magazine and is considerably rotated to be contained in the detecting end containing portion formed at the face of the magazine opposed to the nail containing portion. As a result, the angle of pivoting the nail detecting lever is increased, the nail detecting lever is firmly engaged with the idle striking preventing arm and idle striking is firmly prevented.

According to the nailing machine of the invention, the nail detecting lever to be engaged with the shaft portion of the nail at inside of the nail containing portion is rotatably arranged between the downwardmost pusher and the pusher thereabove, by containing the detecting end of the nail detecting lever in the recess portion formed on the opposed side interposing the nail containing portion, the amount of rotating the nail detecting lever is increased and therefore, even in the case of the magazine for charging the finishing nail having an extremely slender diameter of the shaft portion of the nail, it is firmly detected that the number of the nails becomes equal to or smaller than the predetermined number of pieces, and idle striking is prevented.

The invention claimed is:

1. A nailing machine comprising:

a magazine for charging connected nails;

an injection port formed on a front side of the magazine;

a drive mechanism for striking out a nail supplied into the injection port from the injection port;

a starting mechanism for starting the drive mechanism;

a nail containing portion formed at the magazine for containing the connected nails and guiding the nails in a direction of the injection port;

a plurality of pushers arranged along a direction of a length of the nail for pressing the connected nails in the direction of the injection port by being engaged with a nail at a rearmost portion of the connected nails charged into the nail containing portion and supplying the nails into the injection port;

a nail detecting lever rotatably arranged between a downwardmost pusher and the pusher thereabove on one side of the magazine interposing the nail containing portion and having a detecting end capable of advancing to inside of the nail containing portion;

a detecting end containing portion formed to be able to contain the detecting end of the nail detecting lever on the other side of the magazine interposing the nail containing portion; and an idle striking preventing arm, an upper end of which is arranged at a vicinity of the starting mechanism, a lower end of which is arranged to be opposed to an end portion on a side opposed to the detecting end of the nail detecting lever and which is operated to start the drive mechanism in cooperation with the starting mechanism.

2. The nailing machine according to claim 1, wherein the one side of the magazine interposing the nail containing portion comprises a magazine main body, the other side of the magazine interposing the nail containing portion comprises a slider and the detecting end containing portion is formed at the slider.

3. The nailing machine according to claim 1, wherein the nail detecting lever is made to be rotatable between a first position for hampering the idle striking preventing arm from moving downward by hampering the detecting end from advancing to the nail containing portion by being engaged with a side portion of the connecting nail when the connected nails are contained at inside of the nail containing portion and a second position for permitting the idle striking preventing arm from moving downward by containing the detecting end at inside of the detecting end containing portion when the connected nails are not contained at inside of the nail containing portion.

4. The nailing machine according to claim 1, wherein the connected nails are formed by adhering the contiguous nails by an adhering agent and connecting the nails in a straight shape.

5. The nailing machine according to claim 1, wherein the plurality of pushers are independently urged to a front side by respectively operated springs.

6. The nailing machine according to claim 1, wherein the downwardmost pusher is arranged at a position where the downwardmost pusher is capable to be engaged with a shaft portion of a shortest nail capable of being charged into the magazine, so as to press to supply the nail to the front side.

7. A magazine of a nailing machine, the magazine comprising:

a main body;

a slider;

a nail containing portion formed between the main body and the slider for containing connected nails and guiding the nail in a direction of an injection port of the nailing machine;

a plurality of pushers engaged with the nail at a rearmost portion of the connected nails charged into the nail containing portion to press the connected nails in the direction of the injection port, supplying the nail into the injection port and arranged along a length direction of the nail;

a nail detecting lever arranged at the main body rotatably between the downwardmost pusher and the pusher thereabove and having a detecting end capable of advancing into the nail containing portion; and a detecting end containing portion formed at the slider to be able to contain the detecting end of the nail detecting lever.

8. The magazine according to claim 7, wherein the connected nails are formed by adhering the contiguous nails by an adhering agent and connecting the nails in a straight shape.

9. The magazine according to claim 7, wherein the plurality of pushers are independently urged to a front side by respectively operated springs.

10. The magazine according to claim 7, wherein the downwardmost pusher is arranged at a position where the downwardmost pusher is capable to be engaged with a shaft portion of a shortest nail capable of being charged into the magazine, so as to press to supply the nail to the front side.

* * * * *